US010115372B2

(12) United States Patent
Whang et al.

(10) Patent No.: US 10,115,372 B2
(45) Date of Patent: Oct. 30, 2018

(54) DISPLAY APPARATUS AND CONTROLLING METHOD THEREOF

(71) Applicants: SAMSUNG ELECTRONICS CO., LTD., Suwon-si (KR); FUSEPROJECT, San Francisco, CA (US)

(72) Inventors: Se-jung Whang, Seoul (KR); Yves Behar, San Francisco, CA (US); Arthur Kenzo Debaigue, San Francisco, CA (US); Alex Farrow, San Francisco, CA (US); Anthony Decosta, Danville, CA (US)

(73) Assignees: SAMSUNG ELECTRONICS CO., LTD., Suwon-si (KR); FUSEPROJECT, San Francisco, CA (US)

( * ) Notice: Subject to any disclaimer, the term of this patent is extended or adjusted under 35 U.S.C. 154(b) by 0 days.

(21) Appl. No.: 15/477,472

(22) Filed: Apr. 3, 2017

(65) Prior Publication Data

US 2017/0316757 A1 Nov. 2, 2017

Related U.S. Application Data

(60) Provisional application No. 62/329,481, filed on Apr. 29, 2016.

(30) Foreign Application Priority Data

Dec. 5, 2016 (KR) ..... 10-2016-0164591

(51) Int. Cl.

| | |
|---|---|
| ***G09G 5/10*** | (2006.01) |
| ***G09G 3/3233*** | (2016.01) |
| ***G09G 3/36*** | (2006.01) |
| ***G09G 3/34*** | (2006.01) |

(52) U.S. Cl.

CPC ..... *G09G 5/10* (2013.01); *G09G 3/3233* (2013.01); *G09G 3/342* (2013.01); *G09G 3/3666* (2013.01); *G09G 2320/0686* (2013.01); *G09G 2360/144* (2013.01)

(58) Field of Classification Search

None

See application file for complete search history.

(56) References Cited

U.S. PATENT DOCUMENTS

| | | | | |
|---|---|---|---|---|
| 2007/0257928 | A1* | 11/2007 | Marks | G06F 3/14 345/581 |
| 2012/0133790 | A1 | 5/2012 | Sams | |
| 2014/0306980 | A1 | 10/2014 | Won et al. | |
| 2016/0106294 | A1 | 4/2016 | Mongeon et al. | |

FOREIGN PATENT DOCUMENTS

| | | | |
|---|---|---|---|
| JP | 10-83146 | A | 3/1998 |
| JP | 2003-200678 | A | 7/2003 |
| KR | 10-2014-0122458 | A | 10/2014 |
| KR | 10-2015-0146375 | A | 12/2015 |

* cited by examiner

*Primary Examiner* — Nicholas Lee

(74) *Attorney, Agent, or Firm* — Sughrue Mion, PLLC

(57) ABSTRACT

A display apparatus is provided. The display apparatus includes a sensor configured to sense ambient light, a display configured to provide a screen including a first area which displays content and a second area outside the first area and a processor configured to change a size of the second area based on the sensed ambient light.

17 Claims, 14 Drawing Sheets

DISPLAY APPARATUS AND CONTROLLING METHOD THEREOF

CROSS-REFERENCE TO RELATED APPLICATIONS

This application claims the benefit of U.S. Provisional Application No. 62/329,481, filed in the U.S. Patent and Trademark Office on Apr. 29, 2016, and priority from Korean Patent Application No. 10-2016-0164591, filed in the Korean Intellectual Property Office on Dec. 5, 2016, the disclosures of which are incorporated herein by reference in their entireties.

BACKGROUND

1. Field

Apparatuses and methods consistent with exemplary embodiments relate to a display apparatus and a controlling method thereof, and more particularly, to a display apparatus which provides a plurality of display modes and a controlling method thereof.

2. Related Art

Various types of electronic apparatuses are being developed and distributed due to the development of electronic technologies. In particular, display apparatuses such as a television (TV), one of the most commonly used household appliances, have been rapidly developing in recent years.

In the past, display devices have been widely used to provide content. However, as a screen of a display device is enlarged and resolution thereof is improved, various other uses are being sought after and developed. Especially, the need to provide various functions such as providing an aesthetic function by using a display device has emerged.

SUMMARY

One or more exemplary embodiments provide a display apparatus capable of providing different functions according to different display modes and a controlling method thereof.

According to an aspect of an exemplary embodiment, there is provided a display apparatus including: a sensor configured to sense ambient light; a display configured to provide a screen including a first area which displays a content and a second area outside the first area; and a processor configured to change a size of the second area based on the sensed ambient light.

The processor may be further configured to divide the second area into a plurality of edge areas based on the sensed ambient light and change respective sizes of the plurality of edge areas.

The processor may be further configured to reduce a size of at least one first edge area among the plurality of edge areas, the at least one first edge area being located in an incident direction of the sensed ambient light and enlarge a size of at least one second edge area among the plurality of edge areas, the at least one second edge area being located in a direction opposite to the incident direction of the sensed ambient light.

The processor may be further configured to change respective sizes of the at least one first edge area and the at least one second edge area based on an intensity of the sensed ambient light.

The processor may be further configured to reduce a size of the at least one first edge area and enlarge a size of the at least one second edge area while maintaining a size of the first area.

The processor may be further configured to divide the second area into the plurality of edge areas based on at least one among an intensity of the sensed ambient light and an incident direction of the sensed ambient light.

The processor may be further configured to determine a number of the plurality of edge areas based on the intensity of the sensed ambient light and determine boundaries of the plurality of edge areas based on the incident direction of the sensed ambient light.

The processor may be further configured to change a size of the second area in response to an intensity of the sensed ambient light being greater than a predetermined value.

The processor may be further configured to determine a change in a size of the second area based on an average luminance of the content.

According to an aspect of another exemplary embodiment, there is provided a method of controlling a display apparatus, the method including: providing a screen including a first area which displays a content and a second area outside the first area; sensing ambient light; and changing a size of the second area based on the sensed ambient light.

The changing may include dividing the second area into a plurality of edge areas based on the sensed ambient light and changing respective sizes of the plurality of edge areas.

The changing may include reducing a size of at least one first edge area among the plurality of edge areas, the at least one first edge area being located in an incident direction of the sensed ambient light and enlarging a size of at least one second edge area among the plurality of edge areas, the at least one second edge area being located in a direction opposite to the incident direction of the sensed ambient light.

The changing may include changing respective sizes of the at least one first edge area and the at least one second edge area based on an intensity of the sensed ambient light.

The changing may include reducing a size of the at least one first edge area and enlarging a size of the at least one second edge area while maintaining a size of the first area.

The changing may include dividing the second area into the plurality of edge areas based on at least one among an intensity of the sensed ambient light and an incident direction of the sensed ambient light.

The changing may include determining a number of the plurality of edge areas based on the intensity of the sensed ambient light and determining boundaries of the plurality of edge areas based on the incident direction of the sensed ambient light.

The changing may include changing a size of the second area in response to an intensity of the sensed ambient light being greater than a predetermined value.

The changing may include determining a change in a size of the second area based on an average luminance of the content.

According to an aspect of yet another exemplary embodiment, there is provided a non-transitory computer readable recording medium having embodied thereon a program, which when executed by a processor of a display apparatus causes the display apparatus to execute a method, the method including: providing a screen including a first area which displays a content and a second area outside the first area; sensing ambient light; and changing a size of the second area based on the sensed ambient light.

DETAILED DESCRIPTION OF EXEMPLARY EMBODIMENTS

Figure 1A:
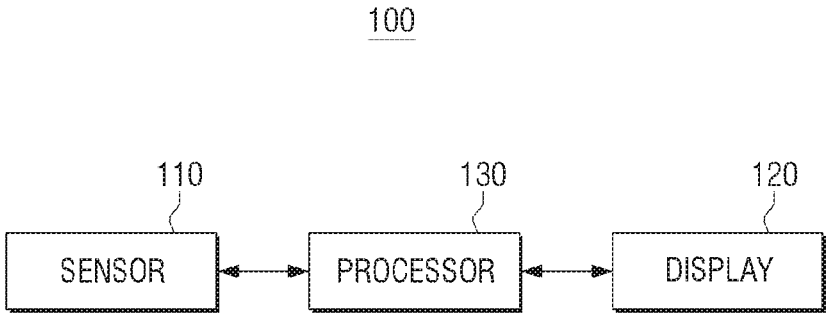
FIG. 1A is a view illustrating a display apparatus according to an exemplary embodiment.

Exemplary embodiments may be diversely modified. Specific exemplary embodiments are illustrated in the drawings and described in detail. However, it is to be understood that the present disclosure is not limited to exemplary embodiments specifically described herein, but includes all modifications, equivalents, and substitutions without departing from the scope and spirit of the present disclosure. Also, well-known functions or constructions are not described in detail since they would obscure the disclosure with unnecessary detail. Expressions such as "at least one of," when preceding a list of elements, modify the entire list of elements and do not modify the individual elements of the list.

Hereinafter, various exemplary embodiments are explained in detail with reference to the attached drawings.

FIG. 1A is a view illustrating a display apparatus 100 according to an exemplary embodiment. FIG. 1A illustrates that the display apparatus 100 includes a sensor 110, a display 120 and a processor 130.

The display apparatus 100 according to various exemplary embodiments includes at least one display and is configured to execute an application or display content. The display apparatus 100, for example, may be a digital television, a tablet, a personal computer (PC), a portable multimedia player (PMP), a personal digital assistant (PDA), a smart phone, a cell phone, a digital frame, a digital signage or a kiosk.

The display device 100 may be operated in a standby mode, a frame mode and a watching mode. If the display apparatus 100 is operated in the standby mode, the display apparatus 100 is provided with power but may not provide any information. Alternatively, the display apparatus 100 may display minimal information. For example, the display apparatus 100 may display only information indicating a current mode. Operations of the display apparatus 100 in the frame mode and the watching mode are explained hereinafter.

The sensor 110 may sense ambient light. For example, the sensor 110 may be equipped on a front side of the display apparatus 100 and sense light to which the front side of the display apparatus 100 is exposed.

The sensor 110 may sense intensity and an incident direction, etc. of light. For example, a plurality of sensors 110 may be equipped on each side of the display apparatus 100 and an incident direction of light may be determined based on a side which is exposed to the greatest light intensity among sides of the sensors 110.

The sensor 110 may be a separate light sensor, a one-dimensional light sensor, a two-dimensional light sensor or a combined light sensor. The sensor 110 may be produced with a semiconductor material, and the semiconductor material may be selected based on the used wavelength range.

The sensor 110 may sense natural light but exemplary embodiments are not limited thereto. For example, the sensor 110 may emit artificial light and receive the reflected light. The sensor 110 may be configured to photograph an image such as a camera. In this case, the processor 110 may determine intensity and an incident direction, etc. of light from a photographed image.

The sensor 110 may sense a user. For example, the sensor 110 may be equipped on a front side of the display apparatus 100 and if a user approaches the front side of the display apparatus 100, the sensor 110 may sense the user. The sensor 110 may be equipped on a different position of the display apparatus 100.

The display apparatus 100 may include a plurality of sensors 110. For example, each of the plurality of sensors 110 may be equipped on a front side, a rear side and sides. When the plurality of sensors 110 are equipped, the display apparatus 100 may sense a user approaching from another side in addition to the front side.

The sensor 110 may sense a user through various sensing methods. For example, the sensor 110 may include an infrared ray sensor or sense a user by sensing a motion of the user. In addition, the sensor 110 may include a camera and sense a user by recognizing a face of the user from a photographed image. There may be various methods of sensing a user in addition to the methods and there is no limit on a method.

If the display 120 is in the frame mode, the display 120 may provide a screen including a first area which displays content and a second area outside the first area. For example, an area in a predetermined distance from boundaries of the display 120 is the second area and content may be displayed on the rest of the area. However, exemplary embodiments are not limited thereto and the predetermined distance can be changed without limit. In addition, each of four edges of the display 120 may have a different predetermined distance.

The first area may be called a content providing area, a central area and a main area, etc. The second area may be called a shadow providing area, a peripheral area, a sub area, an edge area, a mat area, a blank area and a frame area, etc. However, terms "first area" and "second area" are used hereinafter.

The display 120 may display content on an entire screen area in the watching mode. Herein, the content displayed on the entire screen area may be different from content displayed on the first area in the frame mode.

Meanwhile, the display 120 may be implemented as a liquid crystal display panel (LCD) or organic light emitting diodes (OLED) display, etc. but exemplary embodiments are not limited thereto. In addition, depending on example embodiments, the display 120 may be implemented as a flexible display or a transparent display, etc.

The processor 130 controls overall operation of the display apparatus 100.

The processor 130 may change a size of the second area based on sensed light. For example, the processor 130 may enlarge a size of the second area as intensity of the sensed light increases.

The processor 130 may divide the second area into a plurality of edge areas based on the sensed light and change sizes of the plurality of edge areas, respectively. The processor 130 may divide the second area into a plurality of areas based on the sensed light. For example, the processor 130 may increase the number of divided areas as intensity of light increases.

Herein, an edge area may be a unit to divide the second area and the plurality of edge areas may be areas divided according to a predetermined dividing method. Alternatively, the plurality of edge areas may be areas divided by a user.

The processor 130 may change each size of the plurality of edge areas based on sensed light. The processor 130 may reduce a size of at least one edge area which is located in an incident direction of the sensed light among the plurality of edge areas and enlarge a size of at least one second edge area which is located in a direction opposite to the incident direction of the sensed light.

For example, the processor 130, in response to an incident direction of sensed light being toward an upper side of the display 100, may provide a shadow effect by reducing a size of at least one first edge area which is located at the upper side of the display 120 and enlarging a size of at least one second edge area which is located at a lower side of the display 120.

However, exemplary embodiments are not limited thereto and the processor 130 may also change sizes of the rest of the edge areas in addition to the size of the edge area in the incident direction of the sensed light. Alternatively, the processor 130 may change only a size of one of the edge area which is located in the incident direction of the sensed light and the edge area which is located in the direction opposite to the incident direction of the sensed light.

Meanwhile, the processor 130 may provide a shadow effect by changing a size of at least one first edge area which is located in an incident direction of sensed light and a size of at least second edge area which is located in a direction opposite to the incident direction of the sensed light among a plurality of edge areas included in the second area based on intensity of the sensed light. For example, the processor 130 may reduce a size of the first edge area and enlarge a size of the second edge area as intensity of light increases.

Meanwhile, the processor 130 may reduce a size of the first edge area and enlarge a size of the at least one second edge area while maintaining a size of the first area. In this case, it may seem that a position of the first area is changed.

Meanwhile, the processor 130 may divide the second area into a plurality of edge areas based on at least one of intensity and an incident direction of sensed light. For example, the processor 130 may determine a number of the plurality of edge areas based on the intensity of the sensed light and determine boundaries of the plurality of edge areas based on the incident direction of the sensed light.

Meanwhile, the processor 130, in response to intensity of the sensed light being greater than a predetermined value, may change a size of the second area. In other words, the processor 130, in response to intensity of light being less than a predetermined value, may not change a size of the second area.

Meanwhile, the processor 130 may determine a degree to change a size of the second area based on average luminance of content.

The processor 130 may control the display apparatus 100 to be operated in one of a plurality of modes provided by the display apparatus 100.

If a user is sensed by the sensor 110 in the standby mode, the processor 130 may be operated in a frame mode by which a screen including the first are which displays first content and the second area outside the first area is provided and, if a predetermined user input is received in the frame mode, the processor 130 may be operated in a watching mode by which second content is displayed on the entire screen area.

Herein, the user input may be a user input which is transmitted via a remote control apparatus. However, exemplary embodiments are not limited thereto and the user input may be received by a button which is equipped with the display apparatus 100. The user input may be received through a UI equipped with the display apparatus 100 and detailed explanations thereof will be described hereinafter.

In addition, the processor 130, in response to a predetermined user input being received in the watching mode, may be operated in the frame mode and, in response to a user not being sensed in the frame mode, may be operated in a standby mode.

However, exemplary embodiments are not limited thereto and the first content and the second content may be the same. For example, the processor 130 may display content that is being displayed in the watching mode on the first area in the frame mode. If the content that was being displayed is a video, the processor 130 may play the video on the first area. Even though the content that was being displayed is a video, only one frame among a plurality of frames of the video may be displayed on the first area. Herein, the processor 130 may display a frame at time of a mode being changed among a plurality of frames on the first area.

Meanwhile, the processor 130 may be operated in the frame mode according to a user input which is predetermined in the standby mode and operated in the standby mode according to a user input which is predetermined in the frame mode. In addition, the processor 130 may be operated in the watching mode according to a user input which is predetermined in the standby mode and be operated in the standby mode according to a user input which is predetermined in the watching mode. Herein, the predetermined user inputs may differ according to a current display mode and a display mode to be changed to.

The processor 130 may be operated in the frame mode in response to a user being sensed in the standby mode and operated in standby mode in response to a user not being sensed in the frame mode. Alternatively, the processor 130 may be operated in the watching mode in response to a user being sensed in the standby mode and operated in the standby mode in response to a user not being sensed in the watching mode.

The processor 130 may determine a mode to be changed based on at least one of a current display mode, the number of sensed user(s), the height of the user(s) and whether the sensed user(s) is registered in the display apparatus 100.

For example, the processor 130 may be operated in the frame mode only in response to two or more than two users being sensed in the standby mode. Alternatively, the processor 130 may be operated in the watching mode only in response to a user's height being 170 cm or more than 170 cm in the standby mode.

Meanwhile, hereinabove, it is explained that a user is sensed, but exemplary embodiments are not limited thereto. For example, the processor 130 may be operated in the frame mode in response to the display apparatus 100 not being used for more than a predetermined time in the watching mode. In other words, the processor 130 may scale down content which is currently displayed and display son the first area in case that even though a user is being sensed but the user does not use the display apparatus 100 for more than a predetermined time (for example, a user is not watching on the display apparatus 100).

Then, the processor 130 may change the content which is currently displayed to different content and display the different content on the first area. In other words, content which is displayed on the entire area of a screen may differ from content which is displayed on the first area.

For example, the content displayed on the entire area of the screen may be content which is selected and watched by a user and the content displayed on the first area may be predetermined content. The predetermined content may be predetermined by a manufacturer but it can be changed by a user without limit.

The processor 130 may change a color of the second area in real time based on a color of the first content which is displayed on the first area. For example, the processor 130 may determine a color of the second area based on an average color of the first content which is displayed on the first area. In addition, in response to the first content being a video, the processor 130 may change a color of the second area in real time based on an average color of each frame.

In the frame mode, in response to a user being sensed for more than a predetermined time, the processor 130 may change luminance of the first area and the second area. For example, in response to a user being sensed for more than 30 seconds in the frame mode, the processor 130 may determine that the user watches the display apparatus 100 and increase luminance of the first area and the second area.

Meanwhile, the processor 130 may overlay and display an image which provides a shadow effect on the second area. Herein, shadow indicates a black shadow which is made on the back of an object when the object hide light and the shadow effect may indicate the same effect as the shadow. Since the first area is a plane surface, it is physically impossible for shadow to be made on the second area. However, a three-dimensional effect may be given on the second area by displaying an image which provides a shadow effect for the first area.

The image which provides the shadow effect may be generated based on at least one of the first area, the second area and a bezel of the display apparatus 100. For example, the processor 130 may generate an image which provides a shadow effect by which it seems like that the first area is protruded. Alternatively, the processor 130 may generate an image which provides a shadow effect by which it seems like that only a bezel(s) of the display apparatus 100 is protruded.

Meanwhile, the processor 130 may change and display at least one of a size and a position of a shadow area which is provided by the shadow effect based on at least one of intensity and an incident direction of sensed light and display. The processor 130 may enlarge a size of a shadow area as the intensity of the sensed light increases. In addition, the processor 130 may change a position of the shadow area when the incident direction of the sensed light is changed.

Herein, the shadow area may be an area which is displayed as a shadow. In other words, an image which provides a shadow effect is displayed on the entire second area but the shadow area may be a part of the image and in this case, the shadow area may be displayed only on a part of the second area.

In addition, the processor 130 may determine at least one edge area which is located in a direction opposite to an incident direction of sensed light among a plurality of edge areas included in the second area as a shadow area and may provide a shadow effect on the shadow area. For example, in response to an incident direction of sensed light being toward an upper side of the display 100, the processor 130 may provide a shadow effect by determining at least one edge area which is located at a lower side of the display 120 as a shadow area.

Meanwhile, the processor 130 may provide a shadow effect by changing luminance of the first area and the second area based on the intensity of the sensed light. For example, in response to the display apparatus 100 being equipped with a backlight, the processor 130 may control the backlight to reduce brightness at night than in the daytime.

Herein, the processor 130 may differentiate a degree to change luminance of the first area from a degree to change luminance of the second area. For example, the processor 130 may make the degree of change in the brightness of the first area greater than that of the second area.

Meanwhile, the display apparatus 100 may further include a storage which is to store information regarding a plurality of display modes. In addition, the storage may store setting information related to a shadow effect and the processor 130, in response to intensity of sensed light being less than or equal to a predetermined threshold value, may provide a shadow effect based on the setting information stored in the storage.

Herein, the setting information may be information which is input when the display apparatus 100 is manufactured but the setting information may be changed by a user without limit. For example, the setting information may be setting information of time period.

Figure 1B:
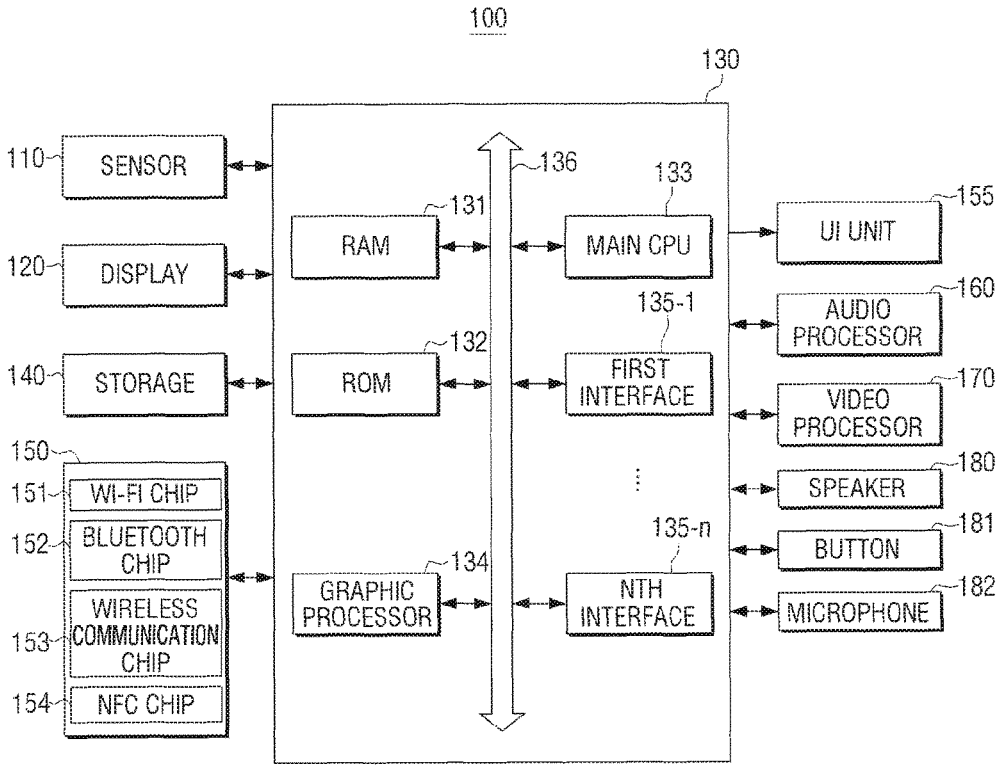
FIG. 1B is a block diagram illustrating a detailed configuration of a display apparatus according to an exemplary embodiment.

FIG. 1B is a block diagram illustrating an example of a detailed configuration of the display apparatus 100. FIG. 1B illustrates that the display apparatus 100 includes the sensor 110, the display 120, the processor 130, a storage 140, a communicator 150, a UI unit 155, an audio processor 160, a video processor 170, a speaker 180, a button 181 and a microphone 182. Detailed explanations which are repetitive to the explanations on the elements illustrated in FIG. 1A among the elements illustrated in FIG. 1B are omitted.

The processor 130 may control overall operation of the display apparatus 100 by using various programs stored in the storage 140.

Specifically, the processor 130 includes RAM 131, ROM 132, a main CPU 133, a graphic processor 134, a first to an n-th interfaces 135-1~**135-*n* and a bus 136**.

RAM 131, ROM 132, the main CPU 133, the graphic processor 134, and the first to the n-th interfaces 135-1~**135-*n* may be connected to each other through the bus 136**.

The first through n-th interfaces 135-1 through **135-*n*** are connected to various types of elements as described above. One of the interfaces may be a network interface which is connected with an external device via a network.

The main CPU 133 may access to the storage 140 and perform the booting by using the O/S stored in the storage 140. Then, the main CPU 133 performs various operations by using various programs stored in the storage 140.

The ROM 132 stores a command set and the like for system booting. If a turn on command is input and thus power is supplied, the main CPU 133 copies the O/S stored in the storage 140 to the RAM 131 and executes the O/S, according to the command stored in the ROM 132, thereby booting the system. If the booting is completed, the main CPU 133 copies various application programs stored in the storage 140 to the RAM 131 and executes the application programs copied to the RAM 131, thereby performing various operations.

The graphics processor 134 generates a screen including various types of objects such as an icon, an image, a text and the like by using an operator (not illustrated) and a renderer (not illustrated). The operator (not illustrated) computes an attribute value, such as a coordinate value where each object is displayed, a form, a size, a color, and the like, according to a screen layout using a received control command. The renderer (not illustrated) generates various layout screens including an object based on the attribute value calculated in the operator (not illustrated). The screen created by the renderer may be displayed in a display region of the display 120.

Meanwhile, the above-described operation of the processor 130 may be performed by a program stored in the storage 140.

The storage 140 stores various data such as an operating system (O/S) software module to drive the display apparatus 100, a display mode providing module, a shadow effect providing module and a display area dividing module, etc.

In this case, the processor 130 may be operated in one mode among a plurality of display modes based on information stored in the storage 140.

The communicator 150 is configured to perform communication with various types of external apparatuses according to various types of communication methods. The communicator 150 includes a Wi-Fi chip 151, a Bluetooth chip 152, a wireless communication chip 153 and a near-field communication (NFC) chip 154, etc. The processor 130 may communicate with various external apparatuses by using the communicator 150.

The Wi-Fi chip 151 and the Bluetooth chip 152 may perform communication using a Wi-Fi method and a Bluetooth method, respectively. When the Wi-Fi chip 151 or the Bluetooth chip 152 is used, a variety of connectivity information, such as SSID and a session key may be transmitted and received first, and communication is established using the connectivity information, and then a variety of information may be transmitted and received. The wireless communication chip 153 indicates a chip which performs communication in accordance with various communication standards such as IEEE, ZigBee, 3rd generation (3G), 3rd generation partnership project (3GPP), and long term evolution (LTE) or the like. The NFC chip 154 may refer to a chip that operates in a NFC manner using a frequency band of 13.56 MHz among various RF-ID frequency bands such as 135 kHz, 13.56 MHz, 433 MHz, 860 to 960 MHz, 2.45 GHz and the like.

Meanwhile, the communicator 150 may perform unilateral communication or bilateral communication with an external apparatus. When unilateral communication is performed, the communicator 150 may receive a signal from an external apparatus. When bilateral communication is performed, the communicator 150 may receive a signal from an external apparatus and transmit a signal to the external apparatus.

The UI unit 155 receives various user interactions. Herein, the user interface 155 may be implemented in various forms according to an example of implementation of the display apparatus 100. In response to the display apparatus 100 being implemented as a digital TV, the UI unit 155 may be realized as a remote control receiver that receives a remote control signal from a remote control apparatus, a camera that senses a user motion or a microphone that receives a user voice, etc. Alternatively, in response to the display apparatus 100 being implemented as a touch-based electronic apparatus, the UI unit 155 may be implemented in a form of touch screen in a layer structure with a touch pad. In this case, the UI unit 155 may be used as the above-described display 120.

The audio processor 160 is an element that performs processing with respect to audio data. The audio processor 160 may perform various processing such as decoding, amplification, noise filtering, etc. with respect to audio data.

The video processor 170 performs processing with respect to video data. The video processor 170 may perform various image processing, such as decoding, scaling, noise filtering, frame rate conversion, resolution conversion, etc. with respect to video data.

The speaker 180 outputs not only various audio data processed by the audio processor 160 but also various notification sounds or voice messages, etc.

The button 181 may be realized as various types of buttons, such as a mechanical button, a touch pad, a wheel, etc., which are formed on the front, side, or rear of the exterior of a main body.

The microphone 183 receives a user voice or other sounds and converts the user voice or other sounds into audio data.

Hereinafter, basic configuration and various example embodiments will be described for better understanding.

Figure 2A:
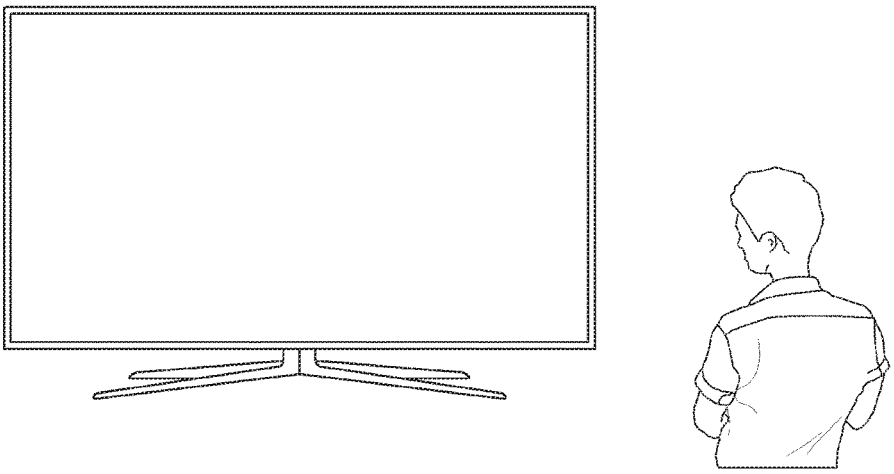
FIGS. 2A, 2B and 2C are views illustrating a plurality of display modes according to an exemplary embodiment.
Figure 2B:
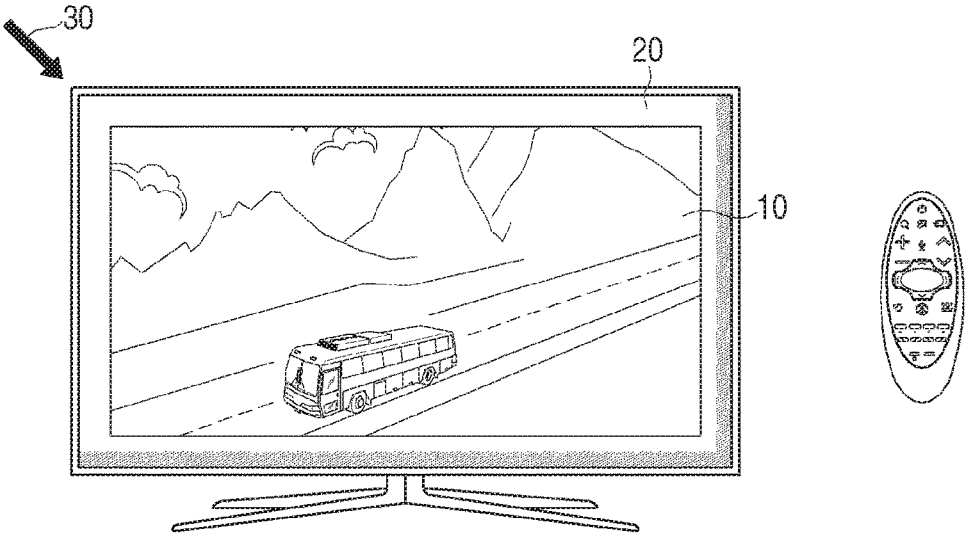

FIGS. 2A to 2B are views illustrating a plurality of display modes according to an exemplary embodiment.

As illustrated in FIG. 2A, the processor 130 may be operated in a standby mode. Even though FIG. 2A illustrates that no information is provided, exemplary embodiments are not limited thereto. For example, the processor 130 may display a UI which induces a user input.

As illustrated in FIG. 2B, in response to a use being sensed in the standby mode, the processor 130 may be operated in a frame mode. The processor 130 may display content on a first area 10 in the frame mode. The processor 130 may display an image which provides a shadow effect on a second area 20. Detailed explanations on the shadow effect are described hereinafter.

Figure 2C:
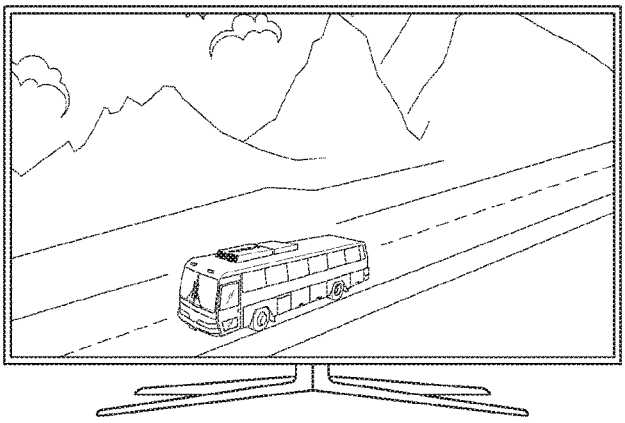

As illustrated in FIG. 2C, in response to a user input being received in the frame mode, the processor 130 may be operated in a watching mode. The processor 130 may display content on the entire screen in the watching mode.

FIGS. 2B and 2C illustrate that content which was displayed on the first area in the frame mode is displayed on the entire screen area in the watching mode, but exemplary embodiments are not limited thereto. For example, content which was displayed on the first area in the frame mode may differ from content which is displayed on the entire screen area in the watching mode. Herein, the content includes a screen setting UI, a channel setting UI and etc. in addition to a content image and a video.

Meanwhile, the processor 130, in response to a user input being received, may be operated in the watching mode from being operated in the standby mode. For example, in response to a power button equipped on a remote control apparatus to control on/off of the display apparatus 100 being manipulated, the processor 130 may be operated in the watching mode from being operated in the standby mode. Alternatively, in response to the power button equipped on the remote control apparatus being manipulated again, the processor 130 may be operated in the standby mode from being operated in the watching mode.

Meanwhile, in response to a user not being sensed for more than a predetermined time in the watching mode or the display apparatus 100 not being used for more than a predetermined time, the processor 130 may provide a screen including the first area 10 and the second area 20.

Specifically, the sensor 110 may sense a user and, the processor 130 may sense at least one of a case that a user is not sensed for more than a predetermined time when content is displayed on the entire area of a screen and a case that the display apparatus 100 is not used for more than a predetermined time.

The processor 130, as illustrated in FIG. 2B, may reduce a size of content to correspond to the first area 10 and display an image which provides a shadow effect on the second area 20.

In this case, a sensor may be a camera and, if it is determined that a user is not detected from an image photographed by the camera or that even if a user is detected, the display apparatus 100 is not used because the user is closing his/her eyes, the processor 130 may be operated in the frame mode.

In other words, in response to the display apparatus 100 not being used by a user, the processor 130 may improve an aesthetic effect by displaying an image which provides a shadow effect.

Specifically, the processor 130 may provide an effect that a frame is hung on by changing content displayed on the first area 10 to a wedding picture and a landscape picture, etc.

In addition, the processor 130 may change content displayed on the first area 10 at predetermined time intervals. The contents displayed on the first area 10 may be predetermined by a manufacturer or changed by a user.

Hereinabove, only the case that a user does not use the display apparatus 100 is explained, however exemplary embodiments are not limited thereto. For example, display apparatus 100 may provide a separate mode changing button for a user to change a mode. The mode changing button may be equipped on the display apparatus 100 and/or a remote control apparatus to control the display apparatus 100. The mode changing button may be embodied as a button to toggle two modes or may be embodied as two mode buttons indicating respective two modes.

Meanwhile, the processor 130 may control the display apparatus 100 to be in the standby mode in one of a case that a user is not sensed for more than a predetermined time in the frame mode and a case that the display apparatus 100 is not used for more than a predetermined time.

Alternatively, the processor 130 may control the display apparatus 100 to be in the standby mode in one of a case that intensity of sensed light in the frame mode is less than a predetermined value and a user is not sensed for more than a predetermined time and a case that the display apparatus 100 is not used for more than a predetermined time.

Hereinafter, operations, especially in the frame mode, are described in detail.

Figure 3:
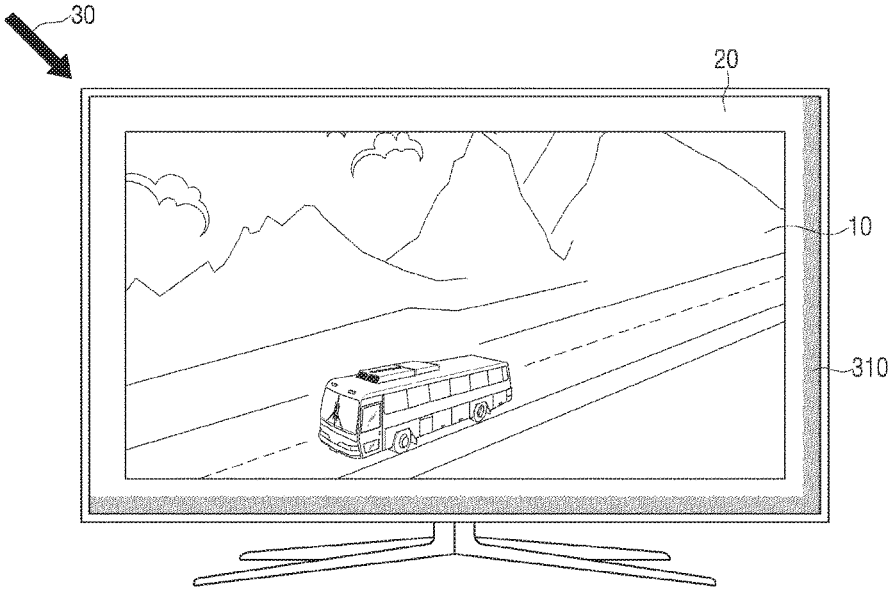
FIG. 3 is a view illustrating a shadow effect according to an exemplary embodiment.

FIG. 3 is a view illustrating a shadow effect according to an exemplary embodiment.

As illustrated in FIG. 3, the processor 130 may provide a screen including the first area 10 which displays content in the frame mode and the second area 20 outside the first area 10. The processor 130 may display predetermined content on the first area 10 and an image which provides a shadow effect of the first area 10 on the second area 20. Herein, the image which provides the shadow effect may be a form which corresponds to the second area 20 except for the first area 10.

A shadow area 310 provided by the shadow effect may be provided only to a part of an image. For example, the processor 130 may darkly display the right side and the bottom side of the second area 20 by providing the shadow area 310 and brightly display the left side and the upper side which are the left areas. Alternatively, as illustrated in FIG. 3, the processor 130 may provide the shadow area 310 only to the right side and the bottom side of the second area 20.

The processor 130 may display the shadow area 310 in the same darkness level. However, exemplary embodiments are not limited thereto. The processor 130 may display the shadow area 310 in different darkness levels. For example, the processor 130 may darkly display the shadow area 310 by applying gradation technique.

In addition, the processor 130 may divide the shadow area 310 into a plurality of areas and differently display at least one of color, chroma and brightness of the plurality of respective areas.

The processor 130 may generate an image through a pre-stored algorithm to generate an image which provides a shadow effect. The predetermined algorithm includes various methods to provide an image providing a shadow effect and the methods are described hereinafter.

However, exemplary embodiments are not limited thereto. The storage 140 may store a plurality of images related to various cases and the processor 130 may display one of the plurality of images.

For example, the storage 140 may store a plurality of image with respect to colors of 256 kinds of shadow effects. Alternatively, the storage 140 may store a plurality of images in which a size of a shadow effect is changed to a pixel unit. The storage 140 may store a plurality of images of which at least one of chroma, brightness and a position of the shadow effect is different, in addition to images of which colors and sizes of the shadow effect are different. The processor 130 may display one of a plurality of images on the second area 20 based on an average color of content displayed on the first area 10.

However, exemplary embodiments are not limited thereto and the processor 130 may randomly select one of the plurality of images and display the image on the second area 20. Alternatively, the processor 130 may display one of a plurality of images on the second area 20 based on the current time.

Meanwhile, a color of an image displayed on the second area 20 may differ from a color of an image which provides a shadow effect. In other words, the processor 130 may display black color on the second area 20 and may overlay and display an image which provides a shadow effect and has the red color shadow area 310 on the second area 20 and display. In this case, the shadow area 310 may be displayed in red color and an area which is not the shadow area 310 in the second area 20 may be displayed in black color.

Meanwhile, FIG. 3 illustrates that one piece of content is displayed on the first area 10 but exemplary embodiments are not limited thereto. For example, the processor 130 may display a plurality of pieces of content on the first area 10.

Figure 4:
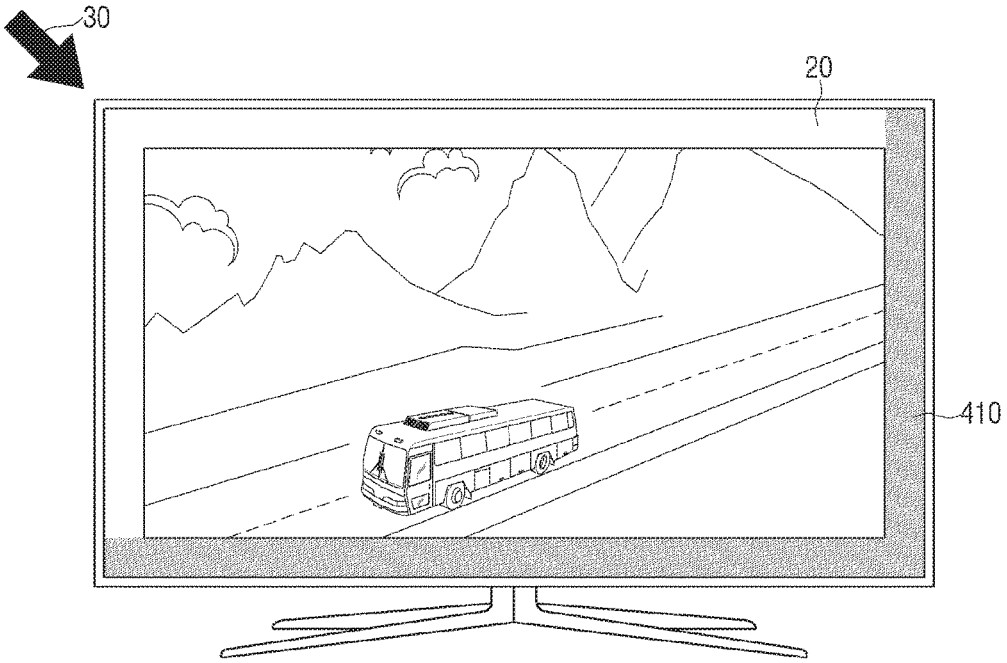
FIG. 4 is a view illustrating an operation according to intensity of light according to an exemplary embodiment.

FIG. 4 is a view illustrating an operation according to intensity of light according to an exemplary embodiment.

FIG. 4 illustrates that the processor 130 changes and displays a size of a shadow area 410 provided by a shadow effect based on intensity of sensed light. In FIGS. 3 and 4, arrows 30 indicating light are illustrated and the thickness of the arrows 30 indicates intensity of the light.

FIG. 4 is a view illustrating that intensity of light is greater than the intensity of light in FIG. 3 and the arrow 30 in FIG. 4 is thicker than the arrow 30 in FIG. 3. The processor 130 may enlarge a size of the shadow area 410 in the case of FIG. 4 more than in the case of FIG. 3.

Figure 5:
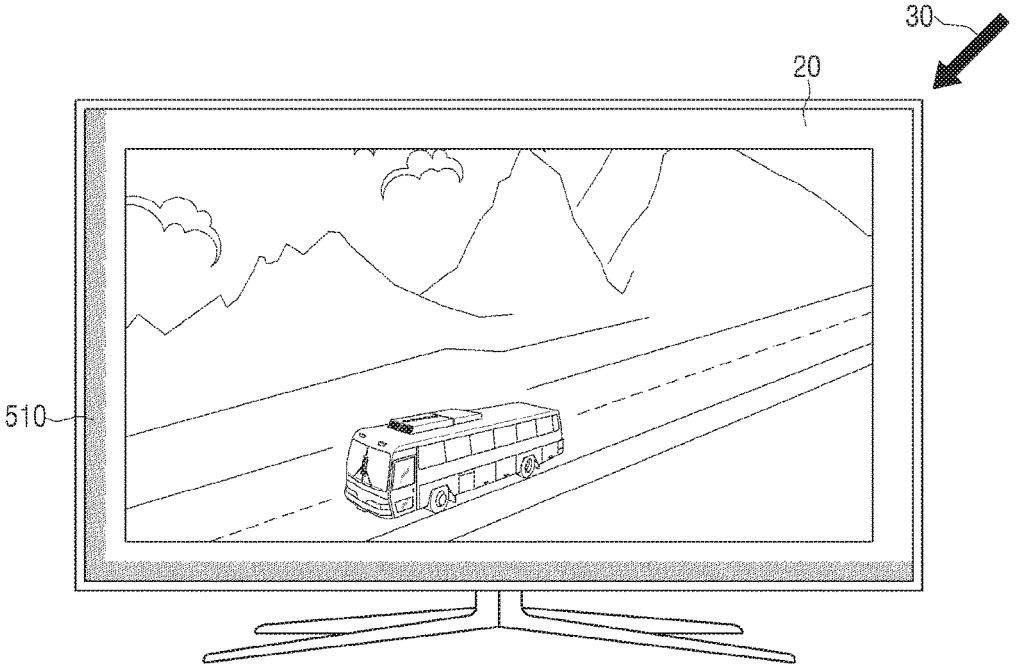
FIG. 5 is a view illustrating an operation according to an incident direction of light according to an exemplary embodiment.

FIG. 5 is a view illustrating an operation according to an incident direction of light according to an exemplary embodiment.

FIG. 5 illustrates that the processor 130 changes and displays a position of a shadow area 510 provided by a shadow effect based on an incident direction of sensed light.

FIG. 5 illustrates that light comes from the right upper side and the processor 130 provides a shadow effect by determining the left side and the bottom side of the second area 20 as the shadow area 510.

Meanwhile, the processor 130 may change a size and a position of the shadow area which is provided by the shadow effect by considering all of intensity and an incident direction of sensed light.

Figure 6A:
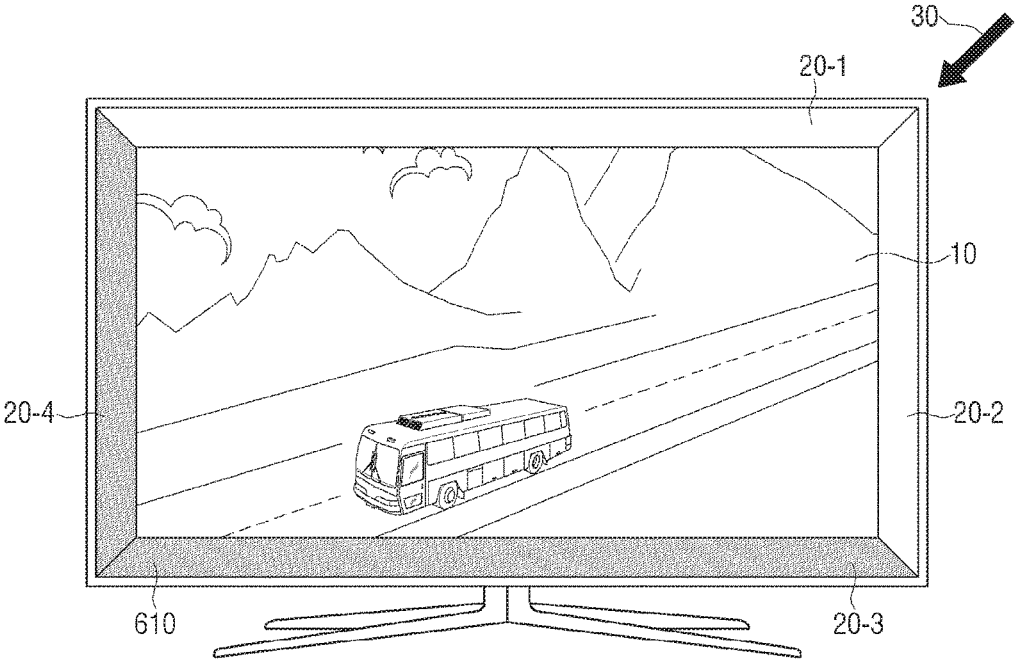
FIGS. 6A and 6B are views illustrating a plurality of edge areas according to an exemplary embodiment.
Figure 6B:
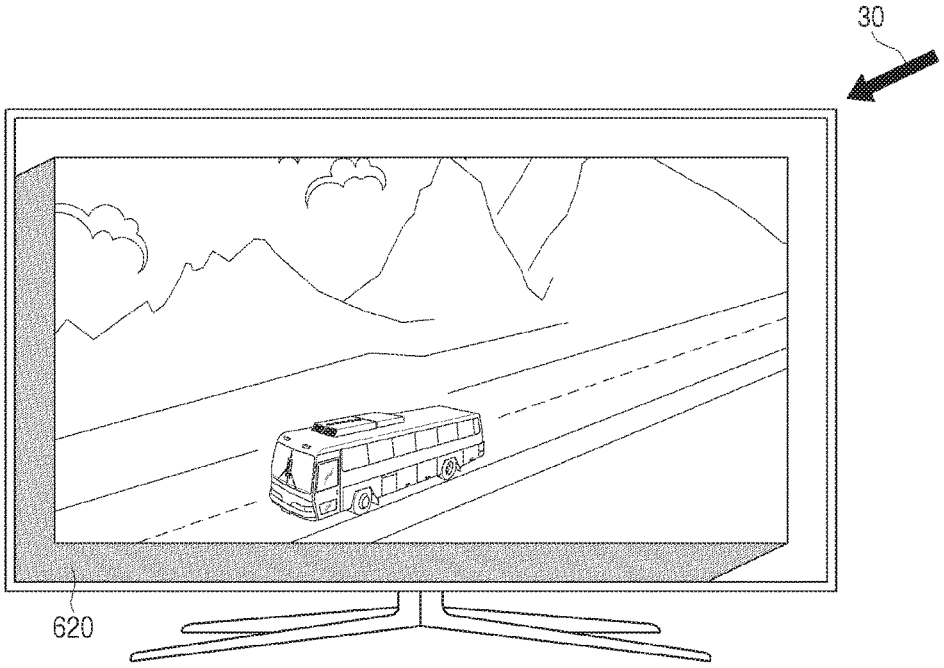

FIGS. 6A and 6B are views illustrating a plurality of edge areas 20-1, 20-2, 20-3, 20-4 according to an exemplary embodiment.

FIG. 6A illustrates that the processor 130 divides the second area 20 into the plurality of areas 20-1, 20-2, 20-3, 20-4. Herein, the dividing into the plurality of areas 20-1, 20-2, 20-3, 20-4 only pertains to an example embodiment and the second area 20 can be divided in any different forms.

The plurality of areas 20-1, 20-2, 20-3, 20-4 may be divided by a manufacturer when the display apparatus 100 is manufactured or may be set by a user.

The processor 130 may provide a shadow effect by determining at least one edge area which is located in a direction opposite to the incident direction of sensed light among the plurality of areas 20-1, 20-2, 20-3, 20-4 as a shadow area 610 and provide a shadow effect.

For example, in response to light coming from the right upper side, the processor 130 may determine the bottom edge area 20-3 and the left edge area 20-4 as the shadow area 610 and provide a shadow effect.

Even though it is explained that at least one edge area which is located in a direction opposite to an incident direction of light is determined as the shadow area 610 with reference to FIG. 6A, exemplary embodiments are not limited thereto. For example, the processor 130 may provide a shadow effect on an area which is within a predetermined distance from a corner which is located in an incident direction of light. In this case, the processor 130 may provide the shadow effect on all of the plurality of edge areas 20-1, 20-2, 20-3, 20-4 but only a part of each edge area may be determined as a shadow area.

Meanwhile, as illustrated in FIG. 6B, the processor 130 may determine a shadow area 620 based on the first area 10 and an incident direction of light. For example, the processor 130 may assume that the first area 10 is protruded and determine shadow which is made by the first area 10 according to the incident direction of the light as the shadow area 620.

Figure 7:
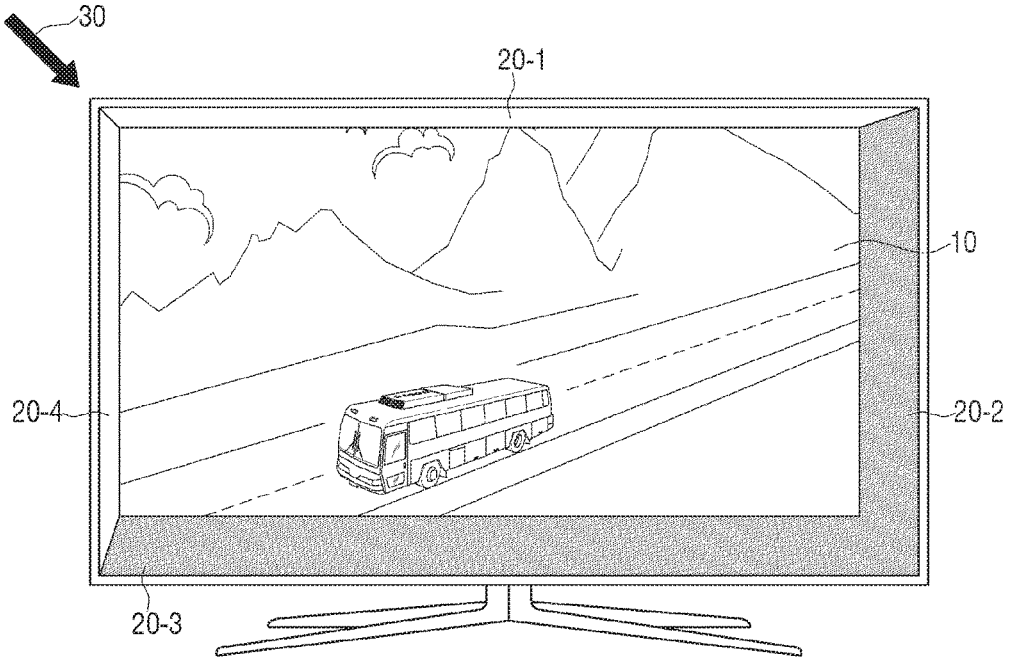
FIG. 7 is a view illustrating size changes of a plurality of edge areas according to an exemplary embodiment.

FIG. 7 is a view illustrating size changes of the plurality of edge areas 20-1, 20-2, 20-3, 20-4 according to an exemplary embodiment.

As illustrated in FIG. 7, the processor 130 may provide a shadow effect by reducing a size of at least one first edge area which is located in an incident direction of sensed light among the plurality of edge areas 20-1, 20-2, 20-3, 20-4 included in the second area 20 and by enlarging a size of at least one second edge area which is located in a direction opposite to the incident direction of the sensed light.

For example, if light comes from the left upper side, the processor 130 may provide a shadow effect by reducing sizes of the upper side edge area 20-1 and the left side edge area 20-4 which are located in the incident direction of sensed light among the plurality of edge areas 20-1, 20-2, 20-3, 20-4 included in the second area 20 and enlarging sizes of the right side edge area 20-2 and the bottom side edge area 20-3 which are located in a direction opposite to the incident direction of the sensed light.

Specifically, the processor 130 may provide a shadow effect by changing each size of the at least one first edge area and the at least one second edge area based on intensity of sensed light.

For example, in response to light coming from the left upper side, the processor 130 may determine sizes to be reduced of the upper side edge area 20-1 and the left side edge area 20-4 and sizes to be enlarged of the right side edge area 20-2 and the bottom side edge area 20-3 based on intensity of sensed light.

Figure 8:
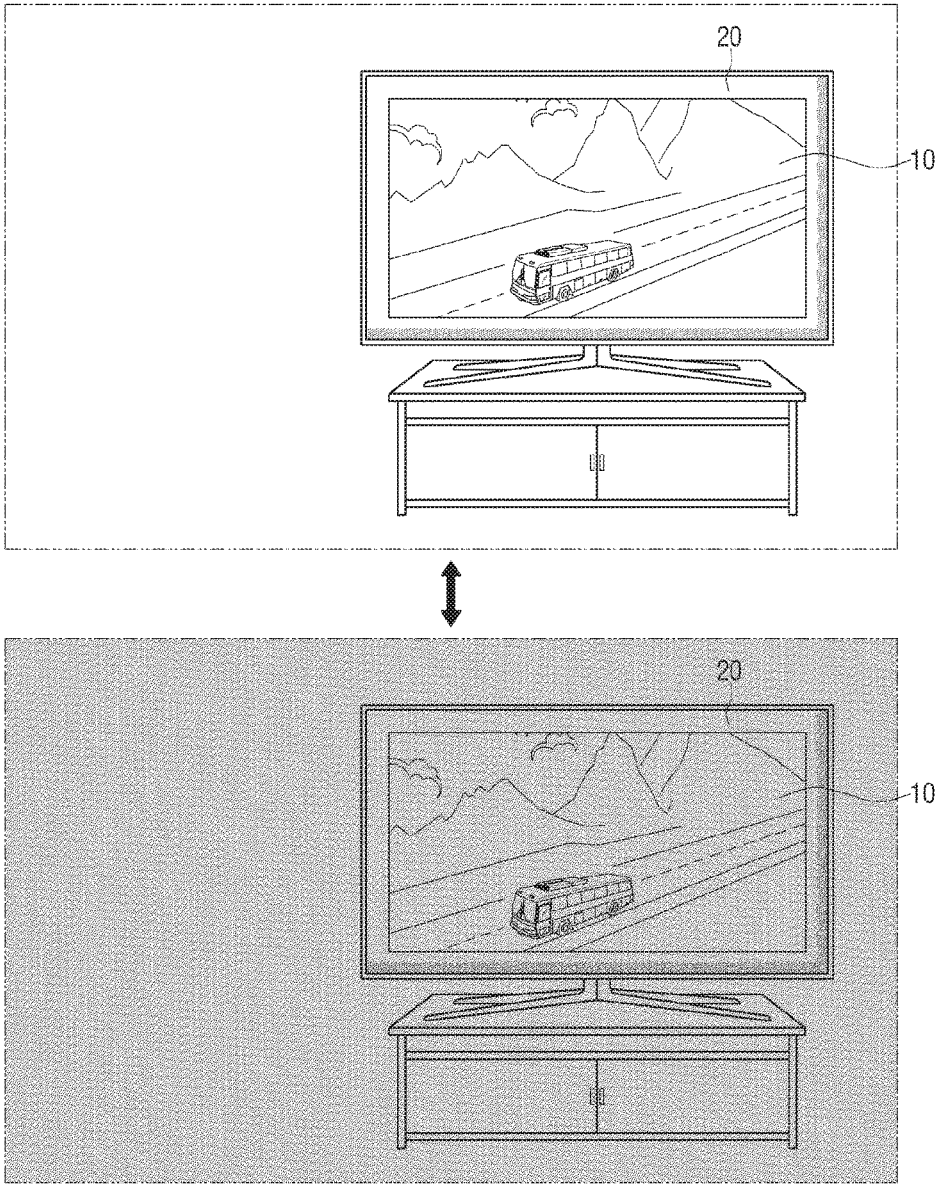
FIG. 8 is a view illustrating luminance changes of a first area and a second area according to an exemplary embodiment.

FIG. 8 is a view illustrating luminance changes of the first area 10 and the second area 20 according to an exemplary embodiment.

The processor 130 may provide a shadow effect by changing luminance of the first area 10 and the second area 20 based on intensity of sensed light.

For example, as illustrated in the first drawing of FIG. 8, the processor 130 may lower the luminance of the first area 10 and the second area 20 if the surrounds become dark as illustrated in the second drawing of FIG. 8 in a state in which content is played on the first area 10 and an image which provides a shadow effect is displayed on the second area 20.

Specifically, in response to the display apparatus 100 having a backlight, the processor 130 may lower luminance of the backlight. In response to the display apparatus 100 not having a backlight, the processor 130 may lower a brightness value of each pixel.

Meanwhile, in response to a user being sensed for more than a predetermined time in the frame mode, the processor 130 may change luminance of the first area 10 and the second area 20. For example, in response to a user being sensed for more than a predetermined time in the frame mode, the processor 130 may increase luminance of the first area 10 and the second area 20.

Figure 9:
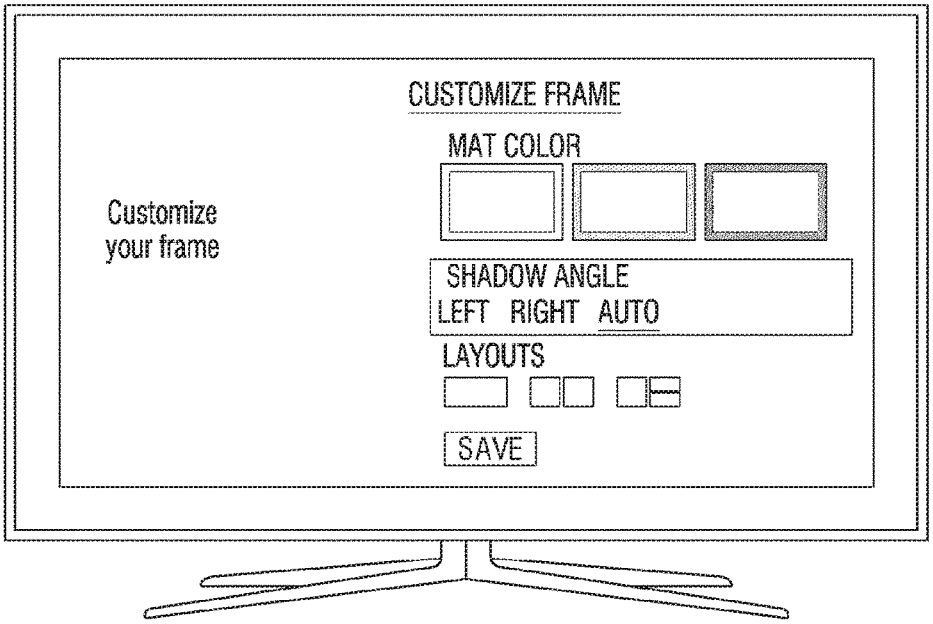
FIG. 9 is a view illustrating a user interface (UI) screen to receive an input of setting information related to a shadow effect according to an exemplary embodiment.

FIG. 9 is a view illustrating a UI screen to receive an input of setting information related to a shadow effect according to an exemplary embodiment.

As illustrated in FIG. 9, the processor 130 may display a UI screen to receive setting information related to a shadow effect. The UI screen to receive setting information related to the shadow effect may include a UI screen for setting a color of a shadow area, a shadow angle and layout, etc.

In addition, the UI to receive setting information related to the shadow effect may include a setting for determining a shadow direction according to a position of the sun by time.

A storage may store the setting information related to the shadow effect. The processor 130, in response to intensity of sensed light being less than or equal to a predetermined threshold value, may provide a shadow effect based on the setting information stored in the storage.

However, exemplary embodiments are not limited thereto and the processor 130 may provide a shadow effect based on the setting information by a user's control regardless of intensity of sensed light. For example, the display apparatus 100 may provide a first frame mode in which the display apparatus 100 is operated by sending light and a second frame mode in which the display apparatus 100 is operated based on setting information and one of the first frame mode and the second frame mode may be determined by a user's selection.

Figure 10:
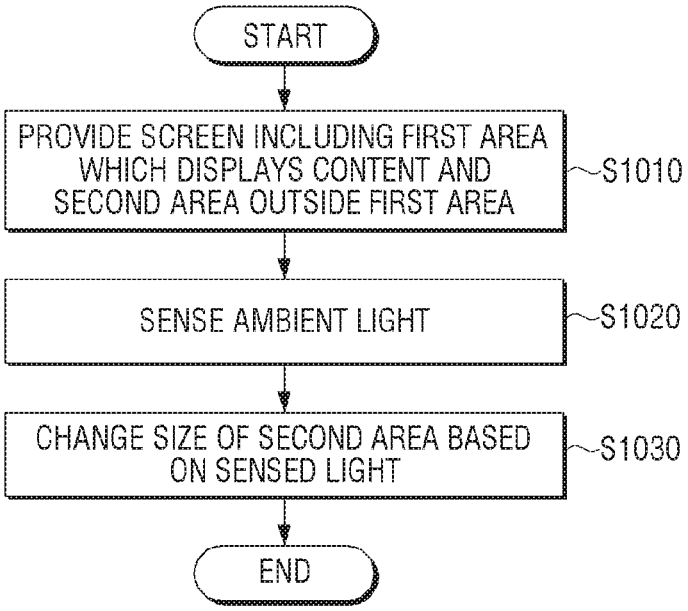
FIG. 10 is a flowchart illustrating a controlling method of a display apparatus according to an exemplary embodiment.

FIG. 10 is a flowchart illustrating a controlling method of a display apparatus according to an exemplary embodiment.

First, a screen including a first area which displays content and a second area outside the first area is provided (S1010) and ambient light is sensed (S1020). A size of the second area is changed based on the sensed light (S1030).

Herein, the changing (S1030) may include dividing the second area into a plurality of edge areas based on sensed light and changing each size of the plurality of edge areas.

The changing (S1030) may include reducing a size of at least one first edge area which is located in an incident direction of the sensed light among the plurality of edge areas and enlarging a size of at least one second edge area which is located in a direction opposite to the incident direction of the sensed light.

Herein, the changing (S1030) may include changing respective sizes of the at least one first edge area and the at least one second edge area based on intensity of the sensed light.

Alternatively, the changing (S1030) may include reducing a size of the first edge area and enlarging a size of the at least one second edge area while maintaining a size of the first area.

Meanwhile, the changing (S1030) may include dividing the second area into the plurality of edge areas based on at least one between intensity and an incident direction of the sensed light.

Herein, the changing (S1030) may include determining the number of the plurality of edge areas based on the intensity of the sensed light and determining boundaries of the plurality of edge areas based on the incident direction of the sensed light.

Meanwhile, the changing (S1030), in response to intensity of the sensed light being greater than a predetermined value, may include changing a size of the second area.

In addition, the changing (S1030) may include determining a degree to change a size of the second area based on average luminance of the content.

According to the various exemplary embodiments, a display apparatus may improve convenience for a user by providing different functions according to whether a user is sensed and a user input.

Meanwhile, it is explained that a shadow area is determined based on sensed light but exemplary embodiments are not limited thereto. For example, a processor may determine a shadow area according to content displayed on a first area.

Meanwhile, hereinabove, it is described that a first area is a rectangular but exemplary embodiments are not limited thereto. For example, the first area may be a circle or a trapezium, etc. According to a shape of the first area, a shape of a second area may be differentiated and shapes of a plurality of edge areas included in the second area may be differentiated.

Meanwhile, methods according to the above-described various exemplary embodiments may be programmed and stored in a storage medium. Accordingly, the methods according to the above-mentioned various exemplary embodiments may be realized in various types of electronic apparatuses to execute a storage medium.

Specifically, a non-transitory computer readable medium recording therein program to sequentially perform the controlling method according to exemplary embodiments may be provided.

The non-transitory computer readable medium refers to a medium that stores data semi-permanently rather than storing data for a very short time, such as a register, a cache or a memory, etc. and is readable by an apparatus. These various applications or programs may be provided in a non-transitory computer readable medium such as a CD, DVD, hard disk, blue ray disk and memory card and ROM, etc.

Although exemplary embodiments have been illustrated and described hereinabove, the present disclosure is not limited to the above-mentioned exemplary embodiments, but may be variously modified by people skilled in the art without departing from the scope and spirit of the inventive concept as disclosed in the accompanying claims.

What is claimed is:

1. A display apparatus comprising:

a sensor configured to sense ambient light;

a display configured to provide a screen including a first area which displays a content and a second area outside the first area; and a processor configured to change a size of the second area based on the sensed ambient light, wherein the processor is further configured to divide the second area into a plurality of edge areas based on the sensed ambient light and change respective sizes of the plurality of edge areas.

2. The apparatus as claimed in claim 1, wherein the processor is further configured to reduce a size of at least one first edge area among the plurality of edge areas, the at least one first edge area being located in an incident direction of the sensed ambient light and enlarge a size of at least one second edge area among the plurality of edge areas, the at least one second edge area being located in a direction opposite to the incident direction of the sensed ambient light.

3. The apparatus as claimed in claim 2, wherein the processor is further configured to change respective sizes of the at least one first edge area and the at least one second edge area based on an intensity of the sensed ambient light.

4. The apparatus as claimed in claim 2, wherein the processor is further configured to reduce a size of the at least one first edge area and enlarge a size of the at least one second edge area while maintaining a size of the first area.

5. The apparatus as claimed in claim 1, wherein the processor is further configured to divide the second area into the plurality of edge areas based on at least one among an intensity of the sensed ambient light and an incident direction of the sensed ambient light.

6. The apparatus as claimed in claim 5, wherein the processor is further configured to determine a number of the plurality of edge areas based on the intensity of the sensed ambient light and determine boundaries of the plurality of edge areas based on the incident direction of the sensed ambient light.

7. The apparatus as claimed in claim 1, wherein the processor is further configured to change a size of the second area in response to an intensity of the sensed ambient light being greater than a predetermined value.

8. The apparatus as claimed in claim 1, wherein the processor is further configured to determine a change in a size of the second area based on an average luminance of the content.

9. A method of controlling a display apparatus, the method comprising:

providing a screen including a first area which displays a content and a second area outside the first area;

sensing ambient light; and changing a size of the second area based on the sensed ambient light, wherein the changing comprises dividing the second area into a plurality of edge areas based on the sensed ambient light and changing respective sizes of the plurality of edge areas.

10. The method as claimed in claim 9, wherein the changing comprises reducing a size of at least one first edge area among the plurality of edge areas, the at least one first edge area being located in an incident direction of the sensed ambient light and enlarging a size of at least one second edge area among the plurality of edge areas, the at least one second edge area being located in a direction opposite to the incident direction of the sensed ambient light.

11. The method as claimed in claim 10, wherein the changing comprises changing respective sizes of the at least one first edge area and the at least one second edge area based on an intensity of the sensed ambient light.

12. The method as claimed in claim 10, wherein the changing comprises reducing a size of the at least one first edge area and enlarging a size of the at least one second edge area while maintaining a size of the first area.

13. The method as claimed in claim 9, wherein the changing comprises dividing the second area into the plurality of edge areas based on at least one among an intensity of the sensed ambient light and an incident direction of the sensed ambient light.

14. The method as claimed in claim 13, wherein the changing comprises determining a number of the plurality of edge areas based on the intensity of the sensed ambient light and determining boundaries of the plurality of edge areas based on the incident direction of the sensed ambient light.

15. The method as claimed in claim 9, wherein the changing comprises changing a size of the second area in response to an intensity of the sensed ambient light being greater than a predetermined value.

16. The method as claimed in claim 9, wherein the changing comprises determining a change in a size of the second area based on an average luminance of the content.

17. A non-transitory computer readable recording medium having embodied thereon a program, which when executed by a processor of a display apparatus causes the display apparatus to execute a method, the method including:

providing a screen including a first area which displays a content and a second area outside the first area;

sensing ambient light; and changing a size of the second area based on the sensed ambient light, wherein the changing comprises dividing the second area into a plurality of edge areas based on the sensed ambient light and changing respective sizes of the plurality of edge areas.

* * * * *